US005305614A

United States Patent [19]

Gilles

[11] Patent Number: 5,305,614

[45] Date of Patent: Apr. 26, 1994

[54] ANCILLARY HEAT PUMP APPARATUS FOR PRODUCING DOMESTIC HOT WATER

[75] Inventor: Theodore C. Gilles, Dallas, Tex.

[73] Assignee: Lennox Industries Inc., Dallas, Tex.

[21] Appl. No.: 20,166

[22] Filed: Feb. 19, 1993

Related U.S. Application Data

[63] Continuation of Ser. No. 785,049, Oct. 30, 1991, abandoned.

[51] Int. Cl.[5] ..... F25B 27/02

[52] U.S. Cl. ..... 62/238.7; 62/430

[58] Field of Search ..... 62/79, 238.6, 238.7, 62/238.1, 430

[56] References Cited

U.S. PATENT DOCUMENTS

| | | | |
|---|---|---|---|
| 4,151,721 | 5/1979 | Kumm | 62/79 |
| 4,173,872 | 11/1979 | Amthor, Jr. | 62/238 |
| 4,194,368 | 3/1980 | Bahel et al. | 62/238 |
| 4,316,502 | 2/1982 | Sanborn et al. | 165/140 |
| 4,330,309 | 5/1982 | Robinson, Jr. | 62/181 |
| 4,363,218 | 12/1982 | Nussbaum | 62/79 |
| 4,391,104 | 7/1983 | Wendschlag | 62/79 |
| 4,399,664 | 8/1983 | Derosier | 62/238.7 |
| 4,434,539 | 3/1984 | Sanborn et al. | 29/157.3 V |
| 4,448,037 | 5/1984 | Hana et al. | 62/238.7 |
| 4,474,018 | 10/1984 | Teagan | 62/79 |
| 4,528,822 | 7/1985 | Glamm | 62/238.7 |
| 4,575,001 | 3/1986 | Oskarsson et al. | 237/2 B |
| 4,598,557 | 7/1986 | Robinson et al. | 62/238.6 |
| 4,665,712 | 5/1987 | Gehring et al. | 62/325 |
| 4,685,307 | 8/1987 | Jones | 62/160 |
| 4,776,180 | 10/1988 | Patton, Sr. et al. | 62/238.6 |
| 4,796,437 | 1/1989 | James | 62/79 |
| 4,856,578 | 8/1989 | McCahill | 165/29 |
| 4,893,476 | 1/1990 | Bos et al. | 62/79 |
| 4,911,741 | 3/1990 | Davis et al. | 62/40 |
| 4,955,207 | 9/1990 | Mink | 62/238.6 |
| 4,955,930 | 9/1990 | Robinson, Jr. | 62/79 |
| 4,959,975 | 10/1990 | Harris | 62/238.6 |
| 5,081,848 | 1/1992 | Rawlings et al. | 62/260 |

FOREIGN PATENT DOCUMENTS

| | | |
|---|---|---|
| 7516977 | 12/1976 | France . |
| 8103219 | 12/1981 | PCT Int'l Appl. . |

OTHER PUBLICATIONS

Hydrotech 2000 brochure-Carrier.

*Primary Examiner*—Henry A. Bennet
*Assistant Examiner*—William C. Doerrler
*Attorney, Agent, or Firm*—Allegretti & Witcoff, Ltd.

[57] ABSTRACT

The ancillary heat pump apparatus of the present invention for producing domestic hot water generally includes a domestic hot water heat pump having refrigerant and water circuits which are operatively disposed at the proximal ends thereof into close array at the heat exchanger of the domestic hot water heat pump. The refrigerant circuit of the domestic hot water heat pump hereof has a heat exchanger coil disposed at the distal end thereof, and the water circuit is connected at the distal end thereof to a hot water heater. In the apparatus of the present invention, the distal refrigerant circuit heat exchanger coil is disposed into operative heat exchanging position, directly or indirectly, with a return fluid stream of a heat source. In preferred embodiments of the present invention, the heat source may be selected from the group consisting of (a) a space conditioning air stream heat pump, (b) a heating and air conditioning system, and (c) a hydronic distribution HVAC system. Other forms of a heat source may likewise be utilized.

24 Claims, 1 Drawing Sheet

ANCILLARY HEAT PUMP APPARATUS FOR PRODUCING DOMESTIC HOT WATER

This is a continuation application Ser. No. 07/785,049, filed Oct. 30, 1991 now abandoned.

BACKGROUND OF THE INVENTION

The present invention relates in general to new, improved and more efficient apparatus for producing domestic hot water (hereinafter sometimes "DHW"), and more particularly to an ancillary heat pump (hereinafter sometimes "AHP") system for such purpose.

Experts within the electric utility industry have determined that the 1990 Federal Clean Air Act and other regulatory action may necessitate replacement of resistance electric heat water heating technology, due to the primary energy intensiveness of the operation of such technology. Some public utility commissions have mandated that the electric utilities replace those residential electric hot water heaters utilizing fossil fuel-fired heaters. Thus, the potential loss of the controllable load of over 20,000,000 residential electric hot water heaters has been of major concern for the utilities. In addition, these energy-related factors have presented utility companies with major marketing problems in regard to new residential construction.

The above problems which are principally related to large levels of primary energy consumption have engendered the search for more energy efficient means of producing domestic hot water. Presently available systems for producing domestic hot water, include, inter alia, integrated and combined space conditioning and water heating heat pump apparatus, self-contained heat pump water heaters, desuperheaters and full condensers (some of which are provided as add-ons to condensing units), heat pipe dehumidification apparatus, and similarly related apparatus.

However, each of these presently available prior art methodologies has associated therewith one or more serious application and/or cost effectiveness problems. Some of the problems associated with the prior art are:

1. the necessity for protecting potable water lines from freezing with an add-on reclaim heat exchanger mounted within an outdoor (condensing) unit;
2. the major additional cost of providing a module with the compressor located indoors;
3. field modification of the refrigerant piping system; and
4. installation cost and application problems associated with dedicated heat pump hot water heaters.

In view of the above difficulties, defects and deficiencies with prior art domestic hot water production systems, it is a material object of the present invention to reduce significantly each of the above and other problems associated therewith.

It is a further object of the present invention to provide an ancillary heat pump system for production of domestic hot water wherein a preferably small and self-contained heat pump having a co-axial heat exchanger and compressor is disposed, in one preferred embodiment, with a heat exchanger coil thereof directly in the return air stream of a heat pump or of a heating and air conditioning system.

It is also an object of the present invention to provide means for injecting the associated cooling effect hereof directly into an accompanying heating and air conditioning system, rather than merely "dumping" such associated cooling effect into the space around the heater tank.

It is also a further object of the present invention to provide apparatus wherein there is no necessity to pipe potable water into an outdoor environment, or, as an alternative, to repipe extensively the refrigeration circuit of the condensing unit to an indoor heat exchanger location, but rather to keep the HVAC and hot water system refrigeration circuits totally isolated, so that there is no risk of water contaminating the HVAC refrigeration system in the event of a heat exchanger failure.

It is a yet further object of the present invention to provide hot water efficiently during the heating season regardless of the type of space heating fuel being used.

These and other objects of the ancillary heat pump apparatus for providing domestic hot water of the present invention will become more apparent to those skilled in the art upon review of the following summary of the invention, brief description of the drawing, detailed description of preferred embodiments, appended claims and accompanying drawing.

SUMMARY OF THE INVENTION

The ancillary heat pump apparatus of the present invention for producing domestic hot water generally includes a domestic hot water heat pump having refrigerant and water circuits which are operatively disposed at the proximal ends thereof into close array at the heat exchanger of the domestic hot water heat pump. The refrigerant circuit of the domestic hot water heat pump hereof has a heat exchanger coil disposed at the distal end thereof, and the water circuit is connected at the distal end thereof to a hot water heater. In the apparatus of the present invention, the distal refrigerant circuit heat exchanger coil is disposed into operative heat exchanging position, directly or indirectly, with respect to a return fluid stream of a heat source. In preferred embodiments of the present invention, the heat source may be selected from the group consisting of (a) a space conditioning air stream heat pump, (b) a heating and air conditioning system, and (c) a hydronic distribution HVAC system. Other forms of a heat source may likewise be utilized.

The above described inventive structure of the ancillary heat pump apparatus of the present invention for producing domestic hot water includes, inter alia, the following desirable features:

1. does not require piping potable water to outdoor ambients;
2. applicable to any heat pump or air conditioning system, including those with space conditioning thermal energy storage (i.e., TES);
3. does not require special indoor compressor HVAC units;
4. totally separated from HVAC system refrigeration piping system;
5. better annual primary energy efficiency than fossil fuel hot water heaters;
6. could be applied with certain available hydronic indoor coil and oversized hot water tank for storage-based space heating load leveling operation; and
7. has a net present value of about $5,000, including space heating revenue benefit, to a typical electric utility.

The following important characteristics are also present in the ancillary heat pump apparatus of the present invention for producing domestic hot water:

1. In the cooling mode, hot water is supplied "free" without the expenditure of any additional kwh of electricity and also in most cases, provides a net power use reduction for air conditioning.
2. Hot water is supplied in the heating season with a COP of 1.70 or higher.
3. Hot water can supplied during mild seasons, without either heating or cooling demands, with a COP of 1.50 to 1.90.

The importance of conserving primary energy is demonstrated in the following analysis:

TABLE A

| | Summer | Winter | Annual |
|---|---|---|---|
| Daily hot water used (gallons) | 105 | 90 | |
| Temperature rise (degrees) | 60 | 75 | |
| Summer energy used (million Btu/year) (125 days) | 6.56 | — | |
| Winter energy used (million Btu/year) (240 days) | — | 13.49 | |
| Average net DHW COP | — | 1.75 | |
| Annual power required, kwh | — | — | 2260 |
| Total Annual hot water energy used (million Btu) | — | — | 20.10 |
| Energy efficiency @ 10500 Btu/kwh (utility heat rate) | — | — | 84.7% |

In comparison, the typical gas-fired water heater recovery efficiency of the prior art is in the range of 76 to 82%, while pilot and off-cycle vent losses reduce the annual efficiency to 65% or less.

The above comparative water heating annual costs are, as follows:

| | |
|---|---|
| Direct element electric heating (5890 kwh @ $0.04) | $236 |
| Gas @ 65% efficiency and $6/mcf | $186 |
| AHP combined inventive system (2,260 kwh @ $0.04) | $90 |

The annual difference of $146 between the direct element electric system and the combined direct hot water with associated ancillary heat pump (AHP) of the present invention would permit the expenditure of $876 additional installed cost (calculated at 10 year, 20% ROI) for the combined hot water heating system. Most importantly, however, the apparatus of the present invention provides a primary energy efficiency and cost effective competitive system which is highly beneficial to consumers and to the electric utilities. These estimates are conservative estimates since a COP of 1.75 has been used. However, an hour-by-hour annual analysis could result in a COP of up to 2.0 for most locations in the United States. Since the apparatus of the present invention will have no water heater gas pilot or off-cycle vent losses, it will improve the overall efficiency of a dwelling that uses gas for space heating, while providing "free" hot water from the air conditioning system.

The additional heat exchanger coil as used herein may require an air filter, but because it is a "dry" coil and may be designed with wide fin spacing (i.e., 8 fpi), such a filter may not be necessary in these embodiments. Moreover, the structure of the present invention can in certain embodiments be optimized as either a full cross-section or partial cross-section, with a bypass configuration to be installed anywhere on the return air side (including exhaust air stream or other unconditioned air stream) of any air conditioning system, whether installed in connection with a split system heat pump, furnace and air conditioner or rooftop single package unit.

These and other aspects and features of the present invention may be better understood with regard to the following brief description of drawing, detailed description of preferred embodiments, appended claims and accompanying drawing.

BRIEF DESCRIPTION OF THE DRAWING

The present invention is set forth in the accompanying drawing, and in which.

DETAILED DESCRIPTION OF PREFERRED EMBODIMENTS

Figure 1:
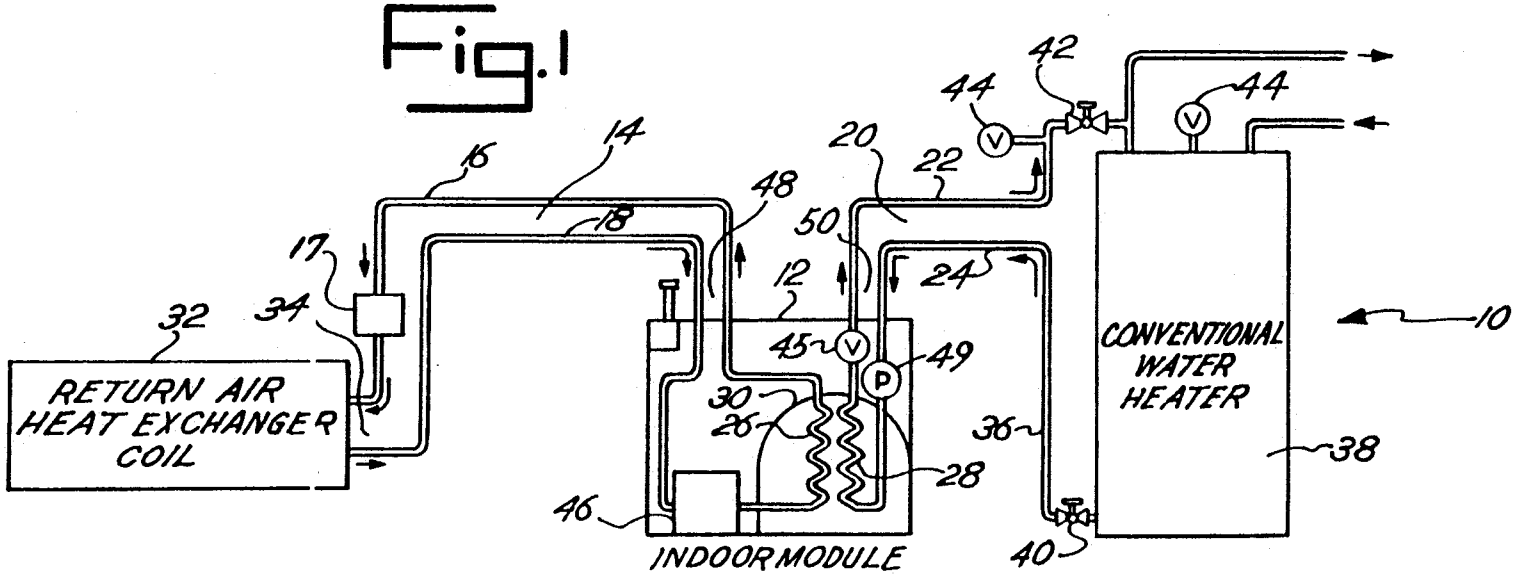
FIG. 1 is a schematic diagram of the ancillary heat pump apparatus of the present invention for production of domestic hot water, primarily for use as an indoor module, and illustrates a return fluid heat exchanger coil disposed at the distal end of the refrigeration circuit thereof and a conventional water heater disposed at the distal end of the water circuit thereof, and further shows a compressor and water circulating pump as a part of said heat pump.

The apparatus of the present invention for producing domestic hot water includes a heat pump dedicated to producing domestic hot water. This domestic hot water heat pump has a refrigerant circuit and a water circuit, which are each operatively disposed at the proximal ends thereof into mutual close array at the heat exchanger element of the domestic hot water heat pump. Each of the refrigerant circuit and the water circuit respectively includes influent and effluent portions. The refrigerant circuit has a heat exchanger coil at the distal end thereof. The water circuit is connected at the distal end thereof to a hot water storage tank, which may be conventional hot water heater.

Most fundamentally, in the apparatus of the present invention, the distal refrigerant circuit heat exchanger coil is disposed into operative heat exchanging position within a return fluid stream of a heat source. The heat source may be of several different types, and may be preferably selected from group consisting of (a) a space conditioning air stream heat pump, (b) a heating and air conditioning system, and (c) a hydronic distribution HVAC system, of known types.

The domestic hot water heat pump may more particularly include a compressor disposed on and downstream of the proximal end of the refrigerant circuit on the influent portion of the refrigerant circuit. The domestic hot water heat pump may further particularly include a water circulating pump disposed upstream of the proximal end of the water circuit and on the influent portion of the water circuit.

The fluid stream of the heat source utilized in association with the present invention may be, in preferred embodiments, a liquid circuit of a hydronic distribution HVAC system, or may constitute a heat source selected from the group consisting of (a) an airstream of a space conditioning heat pump, and (b) a heating and air conditioning system. In these embodiments, a dedicated heat source exchanger may be further provided.

The domestic hot water heat pump utilized in association with the present invention is disposed indoors, in some preferred embodiments. The return fluid stream comprises the unconditioned air stream returning to the space conditioning heat source.

The apparatus for producing domestic hot water of the present invention may also include in other preferred embodiments the disposition of the distal intermediary fluid circuit heat exchanger coil to receive heat indirectly from the heat source. In these and other preferred embodiments, a supplemental heat exchanger means may be provided for operative intermediary heat exchange between the domestic hot water heat pump and the hot water storage tank. Also, in these embodiments, a supplemental hot water heat exchanger means may be disposed inside a building enclosure, and the heat pump may be disposed outside of the building enclosure. Such a structure finds special utility in embodiments wherein propane is utilized. The use of propane as a refrigerant, and in some embodiments in connection with glycol, as an intermediary fluid, permits material avoidance of the use of chloro-or fluoro-carbons, and is thus desirable based upon present perceptions of environmental damage believed to be caused by chloro-or fluoro-carbons.

In such indirect heat exchange embodiments, the heat exchanger means may comprise at least an upstream and a downstream heat exchanger, each of which includes heat input and heat output heat exchange coils. The downstream exchanger heat input coil is connected to a direct heat exchange coil disposed directly within the return fluid stream of the heat source.

Also, in such indirect heat exchange embodiments, the heat output coil of the downstream heat exchanger and the heat input coil of the upstream heat exchanger preferably contain a refrigerant which is substantially free of chloro-or fluoro-carbons. This refrigerant may comprise propane in preferred embodiments. Also in these embodiments, each of the direct heat exchanger coil and the refrigerant effluent line of the supplemental heat exchanger may likewise contain a intermediary fluid which is substantially free of chloro-or fluoro-carbons. This intermediary fluid may preferably comprise glycol.

Figure 2:
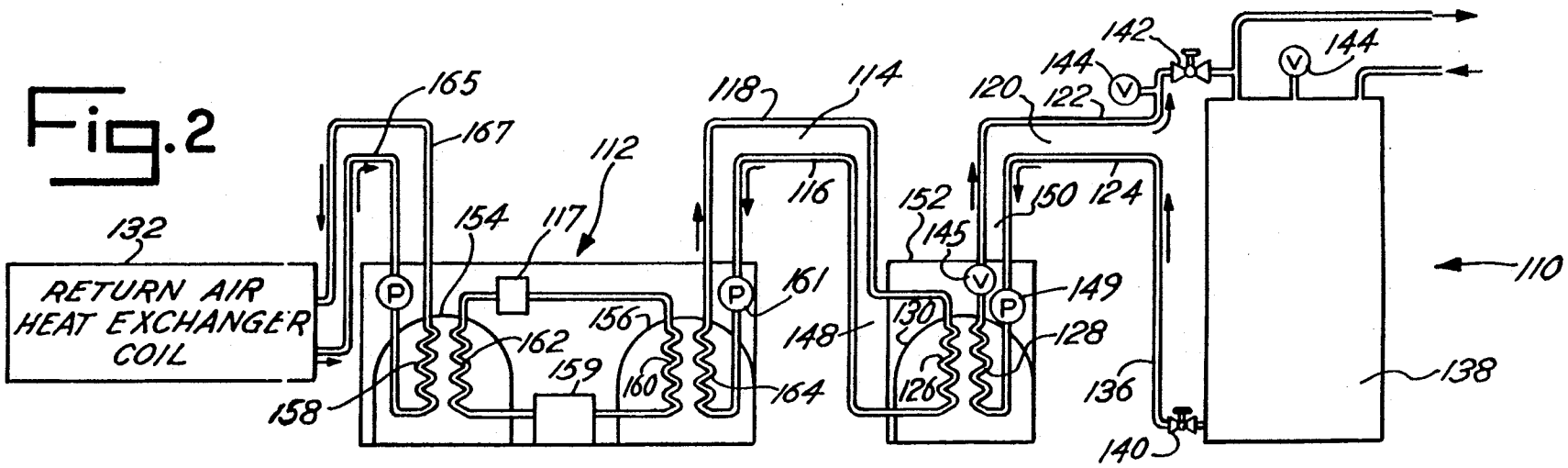
FIG. 2 is a schematic diagram showing an alternative embodiment, primarily for use as an outdoor module, and thus for use with a non-halocarbon, particularly a non-chloro-or fluoro-carbon, and perhaps flammable refrigerant, such as propane (rather than the typically used inflammable refrigerant such as R-22 or other hydrocarbon compounds), and showing the flammable refrigerant as disposed outside the occupied structure, and further showing two supplemental freeze resistant solution fluid circuits (such as glycol or potassium acetate with water) to communicate between the outdoor refrigeration module and the potable water heat exchanger, and thereby with the return fluid heat exchanger disposed within the occupied structure.

The above structures are depicted schematically in FIGS. 1 and 2 of the drawing of the present application, with FIG. 1 depicting an illustrative embodiment suitable for indoor use and FIG. 2 depicting an illustrative embodiment for outdoor use.

Referring now to FIG. 1, wherein diagrammatic symbols known to those skilled in the art are used, the apparatus generally 10 of the present invention for producing domestic hot water includes a heat pump 12 dedicated to producing domestic hot water. Domestic hot water heat pump 12 has a refrigerant circuit 14 comprising refrigerant effluent line 16 with refrigerant expansion device 17 and refrigerant influent line 18, and a water circuit 20 comprising hot water effluent line 22 and cold water influent line 24, which are each operatively disposed at the proximal ends 26,28 thereof into mutual close array at the heat exchanger element 30 of domestic hot water heat pump 12. Refrigerant circuit 14 has a heat exchanger coil 32 at the distal end 34 thereof. Water circuit 20 is connected at the distal end 36 thereof to a hot water storage tank 38, which may be a conventional hot water heater. Suitable conventional valving, such as globe valves 40,42, and temperature pressure relief valve 44, water regulating valve 45, and other valves may be provided in connection with hot water heater 38.

Distal refrigerant circuit heat exchanger coil 32 is disposed into operative heat exchanging position within a return fluid stream of a heat source (not shown). As indicated, supra, the heat source may be of several different types, and may be preferably selected from group consisting of (a) a space conditioning air stream heat pump, (b) a heating and air conditioning system, and (c) a hydronic distribution HVAC system, of known types.

Domestic hot water heat pump 12 may more particularly include a compressor 46 disposed on and downstream of the proximal end 48 of the refrigerant circuit on refrigerant influent line 18 of the refrigerant circuit 14. Domestic hot water heat pump 12 may further particularly include a water circulating pump 49 disposed upstream of the proximal end 50 of water circuit 20 and on the influent line 24 of water circuit 20.

As shown in the alternative (outdoor module) embodiment of FIG. 2, elements common with the embodiment of FIG. 1 (indoor module) are indicted by use of reference numerals adding 100 to the designation set forth in FIG. 1. Thus, the apparatus generally 110 for producing domestic hot water of the present invention may also include in preferred embodiments the disposition of the distal intermediary fluid circuit heat exchanger coil 132 to receive heat indirectly from a heat source. As shown in FIG. 2, a supplemental heat exchanger means generally 152 may be provided for operative intermediary heat exchange between the domestic hot water heat pump and hot water storage tank 138. Also in the embodiments of FIG. 2, domestic hot water heat pump 112 may be disposed outside a building enclosure and supplemental heat exchanger 152 may be disposed inside of the building enclosure. Such a structure finds special utility in embodiments wherein propane is utilized. The use of propane as a refrigerant, and some embodiments in connection with glycol, permits the material avoidance of the use of chloro-or fluorocarbons, and is desirable based upon present perceptions of environmental damage caused by chloro-or fluorocarbons, or other halocarbons.

In the embodiments of FIG. 2, domestic hot water heat pump 112 comprises at least upstream and a downstream heat exchangers 154,156, which respectively include heat input exchange coils 158,160 and heat output heat exchange coils 162, 164. Domestic hot water heat pump 112 includes a compressor 159 with refrigerant expansion device 117 connecting heat exchangers 154,156, as well as a circulating pump 161, of known construction and functionality. Downstream exchanger heat input coil 158 is connected by means of heat transfer fluid influent and effluent lines 165,167 to direct heat exchange coil 132 disposed directly within the return fluid stream (not shown) of the heat source. Heat output coil 162 of downstream heat exchanger 154 and the heat input coil 160 of upstream heat exchanger 156 contain an intermediary refrigerant which is substantially free of chloro-or fluoro-carbons, and which refrigerant may comprise propane in preferred embodiments. Also in these embodiments of FIG. 2, each of domestic hot water heat pump 112 and direct heat exchanger coil 126 may contain a heat transfer fluid which is substantially free of chloro-or fluoro-carbons. This heat transfer fluid may preferably comprise glycol.

Alternative embodiments of the present invention utilize a liquid hydronic circulating loop, which operates according to known methodology in various operational scenarios of hydronic HVAC systems embodiments, and in particular in at least the following modes:

a. direct mode, b. charging storage mode, c. discharging storage mode, and d. mild season domestic hot water heating mode.

With hydronic HVAC systems, air ducts are replaced by hydronic lines. In some embodiments, such as hydronic heat pumps, water-to-water heat exchange may be utilized. Also, in such preferred embodiments, the refrigerant utilized may comprise a wide variety of refrigerant materials.

EXAMPLE I

One of the advantages of the improved heat pump water heater structure of the present invention is the superior theoretical source energy efficiency thereof. Utilization of the structure of the present invention has been shown to increase energy efficiency in the production of domestic hot water in connection with a variety of different forms of primary residential heating equipment. Table B, infra, and the sample calculations related thereto show that a conventional gas-fired domestic hot water heater has an annual efficiency of about 62% (1992 Federal Minimum Efficiency). If a desuperheater heat reclaim unit were to be used with the summer air conditioning unit, the annual primary source energy efficiency would be 92.1%. Those systems, however, have application limited to essentially tropical regions due to the risk of freezing up the potable water lines in the winter.

The heat pump water heater of the present invention with 78% or 95% AFUE gas-fired furnaces in a home and with various electric utility generating heat rates has primary (source) energy efficiencies ranging between 86.2 and 99.6%, as calculated below.

The annual efficiency of the heat pump water heater hereof in homes using a separate heat pump for space heating will be in the range of 85.3 to 92.5%, as calculated below.

TABLE B

| | Summer | Winter |
|---|---|---|
| Gal./day | 105 | 90 |
| Inlet temp. | 60 | 45 |
| Supply temp. | 120 | 120 |
| Days | 125 | 240 |
| Q, $10^6$ Btu | 6.56 | 13.49 |
| Gas water heater, efficiency, % | 62 | |
| Gas furnace 1, efficiency, % | 78 | |
| Gas furnace 2, efficiency, % | 95 | |
| Ancillary heat pump, C.O.P. | 4.00 | |
| Ancillary heat pump C.O.P. with Heat Pump | 1.75 | |
| Utility Heat Rate 1 | 10400 Btu/kWh | |
| Utility Heat Rate 2 | 10000 Btu/kWh | |
| Utility Heat Rate 3 | 9600 Btu/kwh | |

| Domestic Hot Water | Source Energy Efficiency | Site Gas $10^6$ Btu |
|---|---|---|
| Gas heat and gas hot water heating | 62.0 | 32.35[1] |
| Above with heat reclaimer | 92.1 | 21.77[2] |
| Gas heat 1 and Ancillary heat pump | | |
| 10400 | 86.2 | 12.98[3] |
| 10000 | 87.7 | 12.98 |
| 9600 | 89.3 | 12.98 |
| Gas heat 2 and Ancillary heat pump | | |
| 10400 | 95.8 | 10.65[4] |
| 10000 | 97.6 | 10.65 |
| 9600 | 99.6[5] | 10.65 |
| Heat Pump and Ancillary heat pump @ 10400 | 85.3[6] | |
| Heat Pump and Ancillary heat pump @ 10000 | 88.8 | |
| Heat Pump and Ancillary heat pump @ 9600 | 92.5 | |

[1] 6.56/.62 = 10.58
13.49/.62 = 21.77
32.35

[2] 13.49/.62 = 21.77

[3] 13.49 − 13.49/4 = 10.12/.78 = 12.98

[4] 10.12/.95 = 10.65

[5] 13.49/4 × 1/3412 × 9600 = 9.49
10.65
20.14

100 × 20.05/20.14 = 99.6%

[6] 13.49/1.75 × 1/3413 × 10400 = 23.49

100 × 20.05/23.49 = 85.3%

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention without departing from the spirit and scope of such inventions. Accordingly, the preferred and alternative embodiments of the present invention set forth hereinabove are not intended to limit such spirit and scope in any way.

What is claimed is:

1. Apparatus for heating liquid, said apparatus including a heat pump having first and second circuits, first circulation means for circulating refrigerant through said first circuit and second circulation means for circulating liquid to be heated through said second circuit, respective first portions of said first and second circuits being operatively disposed in heat exchange relationship to define a first heat exchanger, a second portion of said first circuit being operatively disposed in heat exchange relationship with a return fluid stream of a primary source of space conditioning and being cooperable therewith to define a second heat exchanger for removing heat from the return fluid stream, the primary source of space conditioning being systemically separate from said heat pump, a second portion of said second circuit being connected to a tank for storing heated liquid.

2. Apparatus of claim 1 wherein said first circulation means includes a compressor.

3. Apparatus of claim 1 wherein said second circulation means includes a liquid circulating pump.

4. Apparatus of claim 1 wherein said second portion of said first circuit includes a heat exchanger coil disposed to receive direct contact by said return fluid stream.

5. Apparatus of claim 1 wherein said primary source is selected from the group consisting of (a) a space conditioning air stream heat pump, (b) a heating and air conditioning system and (c) a hydronic distribution HVAC system.

6. Apparatus of claim 1 wherein said return fluid stream is a liquid circuit of a hydronic distribution HVAC system.

7. Apparatus of claim 6 further including a dedicated heat source heat exchanger.

8. Apparatus of claim 1 wherein said return fluid stream is selected from the group of (a) an air stream of a space conditioning heat pump, and (b) an air stream of a heating and air conditioning system.

9. Apparatus of claim 1 wherein said heat pump is disposed indoors.

10. Apparatus of claim 1 wherein said return fluid stream comprises the air stream returning to a space conditioning system.

11. Apparatus of claim 1 further comprising supplemental heat exchanger means for operative intermediary heat exchange disposed between said heat pump and said tank.

12. Apparatus of claim 11 wherein said heat pump further includes a third heat exchanger disposed between said first and second heat exchangers for operative intermediary heat exchange.

13. Apparatus of claim 11 wherein said refrigerant which is substantially free of halocarbons comprises a flammable heat exchange liquid.

14. Apparatus of claim 12 wherein said supplemental heat exchanger means has a heat exchange coil, which contains an heat exchanger fluid which is substantially free of halocarbons.

15. Apparatus of claim 12 or 14 wherein said heat exchange fluid is selected from the group consisting of (a) a solution of water and glycol, and (b) a solution of water and potassium acetate.

16. Apparatus of claim 15 wherein said flammable heat exchange liquid comprises propane.

17. Apparatus for heating water, said apparatus including a heat pump having a refrigerant circuit and a water circuit, respective first portions of said refrigerant circuit and said water circuit being operatively disposed in heat exchange relationship to define a first heat exchanger, a second portion of said refrigerant circuit being operatively disposed in heat exchange relationship with a return fluid stream of a primary source of space conditioning and being cooperable therewith to define a second heat exchanger, the primary source of space conditioning being systematically separate from said heat pump, a second portion of said water circuit being connected to a tank for storing heated water.

18. Apparatus of claim 11 wherein said heat pump is disposed outside a building enclosure and said supplemental heat exchanges means is disposed inside of said building enclosure.

19. Apparatus of claim 12 wherein said first heat exchanger includes first and second heat exchange coils and said third heat exchanger includes third and fourth heat exchange coils, said first heat exchange coil being connected to said supplemental heat exchanger means and said fourth heat exchange coils containing a refrigerant which is substantially free of halocarbons.

20. Apparatus of claim 17 wherein said water circuit is directly connected to the water within said tank.

21. Apparatus for heating water, said apparatus including a heat pump having a refrigerant circuit and a water circuit, respective first portions of said refrigerant circuit and said water circuit being operatively disposed in heat exchange relationship to define a first heat exchanger, a second portion of said refrigerant circuit being operatively disposable in heat exchange relationship with a return fluid stream of a primary source of space conditioning and being cooperable therewith for defining a second heat exchanger, the primary source of space conditioning being systemically separate from said heat pump, a second portion of said water circuit being connectable to a hot water storage tank, whereby said apparatus is adapted for retrofit connection between the return fluid stream of a primary source of space conditioning and a hot water storage tank.

22. Apparatus of claim 1 wherein said first heat exchanger is located exterior to the tank.

23. Apparatus of claim 17 wherein said first heat exchanger is located exterior to the tank.

24. Apparatus of claim 21 wherein said first heat exchanger is located exterior to the hot water storage tank.

* * * * *